US008305274B2

(12) United States Patent
Shim et al.

(10) Patent No.: US 8,305,274 B2
(45) Date of Patent: Nov. 6, 2012

(54) INTERNAL ANTENNA FOR MITIGATING EFFECT OF ELECTROMAGNETIC WAVES ON HUMAN BODY USING COUPLING

(75) Inventors: Bu-Seok Shim, Gwangmyeong-si (KR); Soon-Jong So, Anyang-si (KR)

(73) Assignee: Ace Antenna Corp., Incheon (KR)

( * ) Notice: Subject to any disclaimer, the term of this patent is extended or adjusted under 35 U.S.C. 154(b) by 538 days.

(21) Appl. No.: 12/610,013

(22) Filed: Oct. 30, 2009

(65) Prior Publication Data

US 2010/0109954 A1 May 6, 2010

(30) Foreign Application Priority Data

Nov. 4, 2008 (KR) ..... 10-2008-0108806

(51) Int. Cl.
*H01Q 1/24* (2006.01)

(52) U.S. Cl. ..... 343/702; 343/841

(58) Field of Classification Search ..... 343/702, 343/841

See application file for complete search history.

(56) References Cited

U.S. PATENT DOCUMENTS

| | | | | |
|---|---|---|---|---|
| 6,031,494 | A * | 2/2000 | Okabe et al. | 343/702 |
| 6,417,817 | B1 * | 7/2002 | Pirila et al. | 343/841 |
| 6,590,539 | B2 * | 7/2003 | shinichi | 343/702 |
| 2004/0032371 | A1 * | 2/2004 | Mendolia et al. | 343/702 |
| 2004/0119654 | A1 * | 6/2004 | Koyama | 343/846 |
| 2008/0207282 | A1 * | 8/2008 | Schaffler | 455/575.3 |

* cited by examiner

*Primary Examiner* — Tho G Phan
(74) *Attorney, Agent, or Firm* — LRK Patent Law Firm

(57) ABSTRACT

Disclosed herein is an internal antenna capable of mitigating the effect of electromagnetic waves on a human body using coupling. The internal antenna includes an antenna pattern part and a conductive conductor pattern. The antenna pattern part is form on the Printed Circuit Board (PCB) of a mobile communication terminal. The conductive conductor pattern is formed in a predetermined pattern on one side surface of a cover which covers the antenna pattern part. Coupling occurs between the antenna pattern part formed on the PCB and the conductive conductor pattern formed in a predetermined pattern on one side surface of the cover, so that current components are transferred from the antenna pattern part to the conductive conductor pattern.

5 Claims, 8 Drawing Sheets

RELATED ART

RELATED ART

RELATED ART

INTERNAL ANTENNA FOR MITIGATING EFFECT OF ELECTROMAGNETIC WAVES ON HUMAN BODY USING COUPLING

BACKGROUND OF THE INVENTION

1. Field of the Invention

The present invention relates generally to an internal antenna for mitigating the effect of electromagnetic waves on a human body using coupling, and, more particularly, to an internal antenna capable of mitigating the effect of electromagnetic waves on a human body using coupling, which transfers current components from an antenna pattern part to a conductive conductor pattern formed in a predetermined pattern on one side surface of a cover which covers the antenna pattern part, thereby blocking electromagnetic waves directed at a human body while maintaining similar radiation performance.

2. Description of the Related Art

As concerns about the effects of electromagnetic waves on a human body increase, international organizations have established standards regarding Specific Absorption Rates (SARs) of the electromagnetic waves for a human body. Accordingly, the types and number of mobile phones to which the SARs for a human body are being applied are increasing. The development of antennas having performance satisfying the above-described standards is impending.

FIG. 1 is a diagram showing the construction of conventional internal antenna. As shown in FIG. 1, the conventional internal antenna includes an antenna pattern part 20 composed of a radiation element 21 and a carrier 22 on a Printed Circuit Board (PCB) 10, and a cover 30 for covering the antenna pattern part 10 is made of plastic resin such polycarbonate (PC) material, so that electromagnetic waves directed at a human body cannot be blocked using only the antenna pattern part 20 composed of the radiation element 21 and the carrier 22.

FIG. 2A is a graph illustrating the Voltage Standing Wave Ratio (VSWR) of a conventional internal antenna, and FIG. 2B is a graph illustrating a radiation pattern in the PCS 1900 (1850 MHz~1990 MHz) band which is the higher of the frequency bands of the conventional internal antenna. As shown in FIG. 2A, in the conventional internal antenna, resonant frequencies are generated in the GSM 850 (824 MHz~894 MHz) band and the PCS 1900 (1850 MHz~1990 MHz) band. Here, a radiation pattern in the PCS 1900 (1850 MHz~1990 MHz) band, which is a higher frequency band, is generated such that energy density is highest within the range of −60 to 0 degrees within which electromagnetic waves generated by the internal antenna are directed at a human body, as shown in FIG. 2B. Accordingly, the conventional internal antenna in which the cover 30 for covering the antenna pattern part 20 is made of plastic resin has a problem in that it cannot block electromagnetic waves directed at a human body.

SUMMARY OF THE INVENTION

Accordingly, the present invention has been made keeping in mind the above problems occurring in the prior art, and an object of the present invention is to provide an internal antenna capable of mitigating the effect of electromagnetic waves on a human body using coupling, in which coupling occurs between an antenna pattern part formed on the PCB of a mobile communication terminal and a conductive conductor pattern formed in a predetermined pattern on one side surface of a cover which covers the antenna pattern part, so that current components are transferred from the antenna pattern part to the conductive conductor pattern, thereby blocking electromagnetic waves directed at a human body.

In order to accomplish the above object, the present invention provides an internal antenna capable of mitigating the effect of electromagnetic waves on a human body using coupling, including an antenna pattern part formed on the Printed Circuit Board (PCB) of a mobile communication terminal; and a conductive conductor pattern formed in a predetermined pattern on one side surface of a cover which covers the antenna pattern part.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
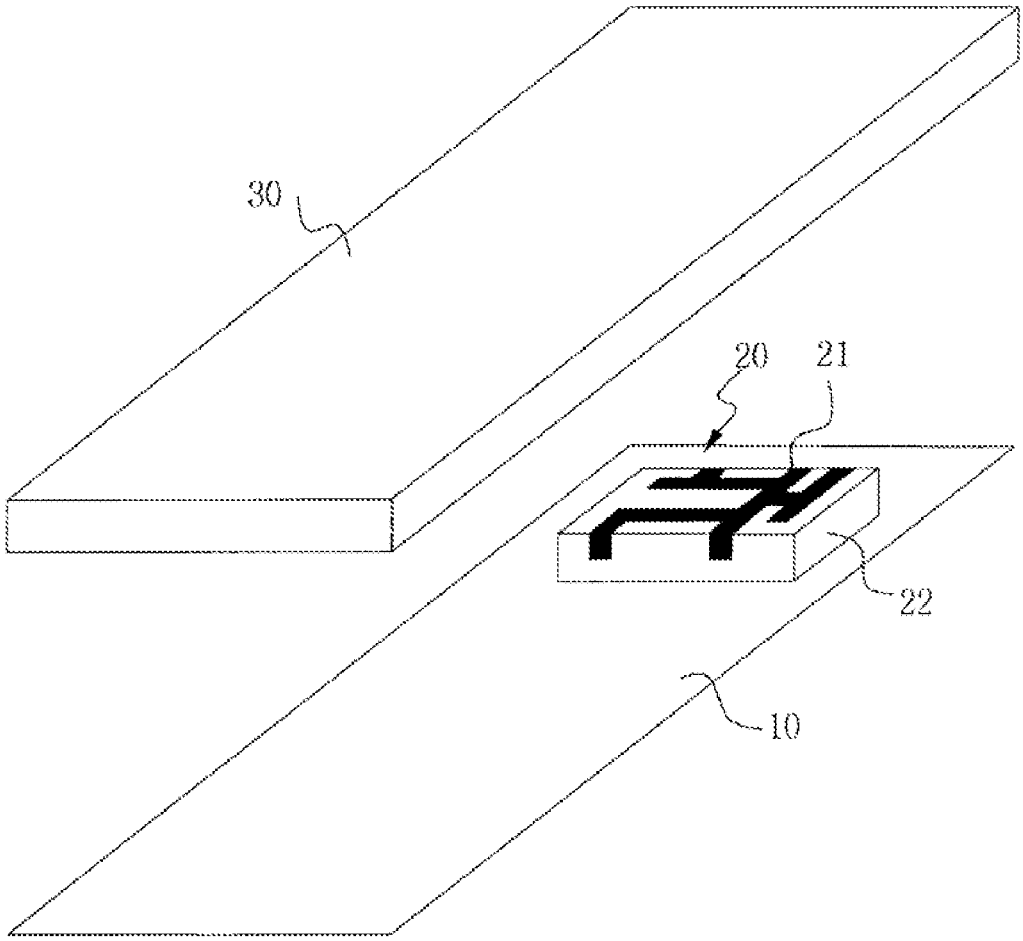
FIG. 1 is a diagram showing the construction of a conventional internal antenna.
Figure 2A:
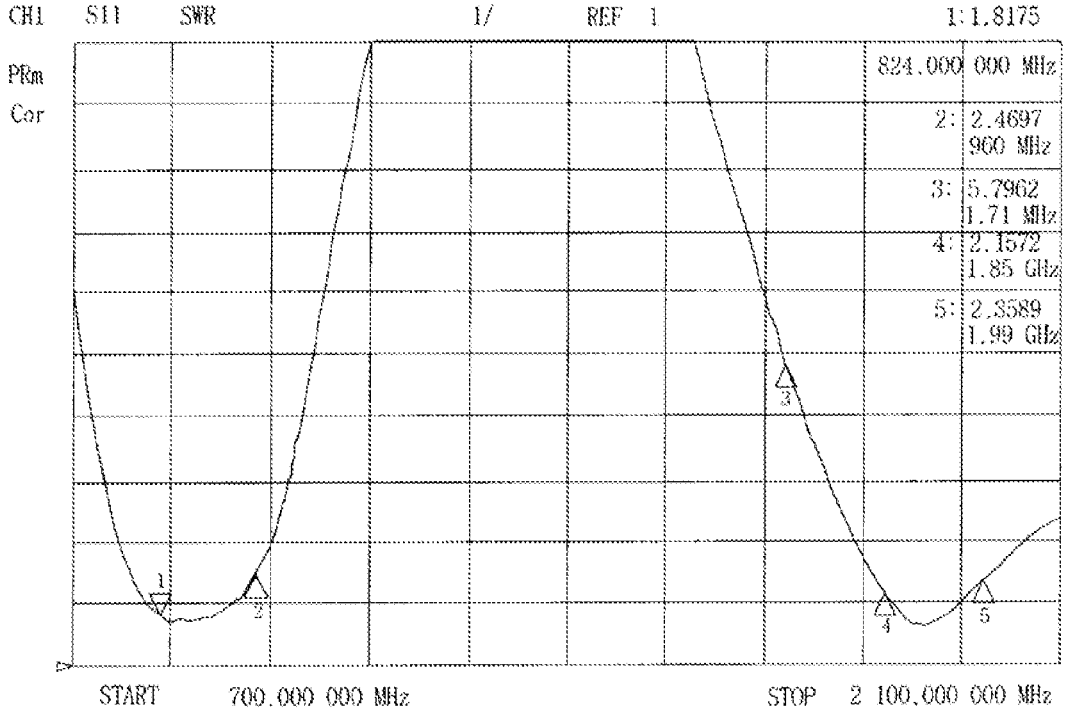
FIG. 2A is a graph illustrating the VSWR of a conventional internal antenna.
Figure 2B:
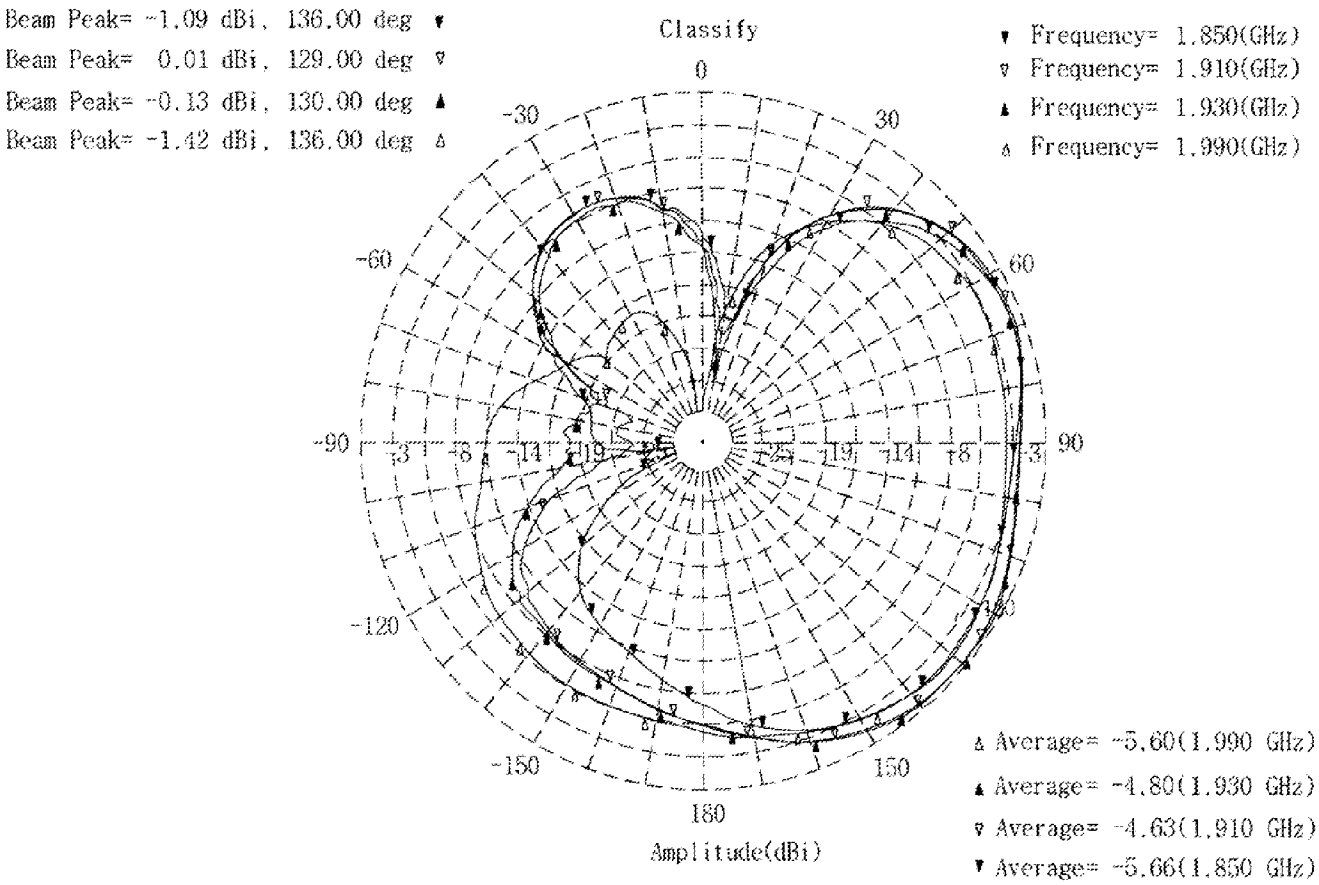
FIG. 2B is a graph illustrating the radiation pattern of the conventional internal antenna.

Reference now should be made to the drawings, in which the same reference numerals are used throughout the different drawings to designate the same or similar components.

Preferred embodiments according to the present invention will be described in detail below with reference to the accompanying drawings.

Figure 3:
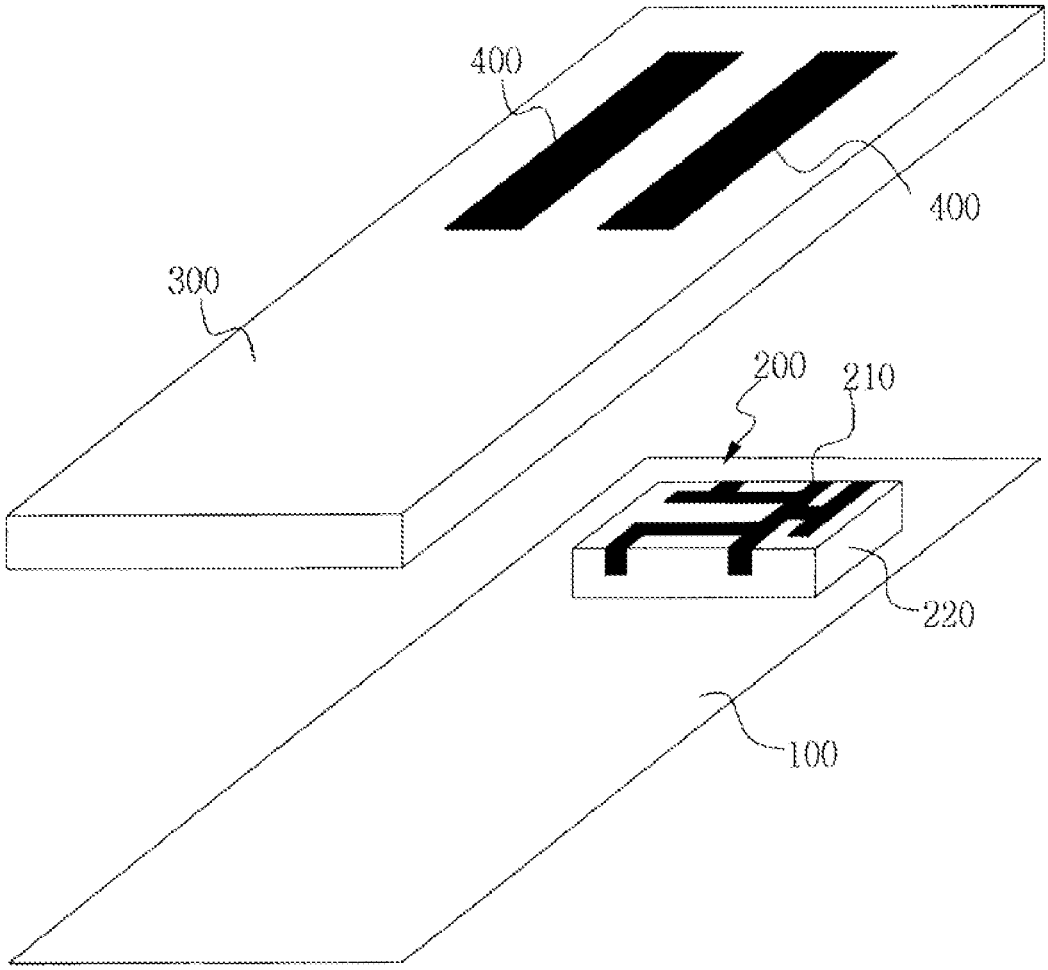
FIG. 3 is a diagram showing the construction of an internal antenna capable of mitigating the effect of electromagnetic waves on a human body using coupling according to an embodiment of the present invention.

FIG. 3 is a diagram showing the construction of an internal antenna capable of mitigating the effect of electromagnetic waves on a human body using coupling according to an embodiment of the present invention.

The internal antenna capable of mitigating the effect of electromagnetic waves on a human body using coupling according to the embodiment of the present invention includes an antenna pattern part 200 formed on a PCB 100 on which the main circuit of a mobile communication terminal is formed and a conductive conductor pattern 400 formed in a predetermined pattern on one side surface of a cover 300 which covers the antenna pattern part 200.

In more detail, the antenna pattern part 200 includes a radiation element 210 and a carrier 220 for supporting and fastening the radiation element 210.

Furthermore, the radiation element 210 formed in the antenna pattern part 200 operates in a dual frequency band. Here, it is preferred that the dual frequency band according to an embodiment of the present invention include the GSM 850 (824 MHz~894 MHz) band and the PCS 1900 (1850 MHz~1990 MHz) band for which standards regarding the effect of electromagnetic waves on a human body have been established.

The conductive conductor pattern 400 according to the present embodiment of the present invention includes a plurality of conductor elements which are formed on one side surface of any one 300 of the body cover 310 and battery cover 320 of a terminal and are symmetrically spaced apart from each other at regular intervals.

Furthermore, the conductive conductor pattern 400 may be any one of a metal sheet pattern, a tin plating pattern, a Flexible Printed Circuit Board (FPCB) pattern and a film pattern.

In this case, coupling occurs between the antenna pattern part 200 and the conductive conductor pattern 400, so that current components are transferred from the antenna pattern part 200 to the conductive conductor pattern 400 formed in a predetermined pattern on any one 300 of the body cover 310 and battery cover 320.

Accordingly, the present invention has an effect in that the antenna pattern part 200 formed on the PCB and the conductive conductor pattern 400 formed on one side surface of the cover 300 which covers the antenna pattern part 100 are electrically coupled to each other, so that current components are transferred from the antenna pattern part 200 to the conductive conductor pattern 400, thereby blocking electromagnetic waves directed at a human body.

Figure 4A:
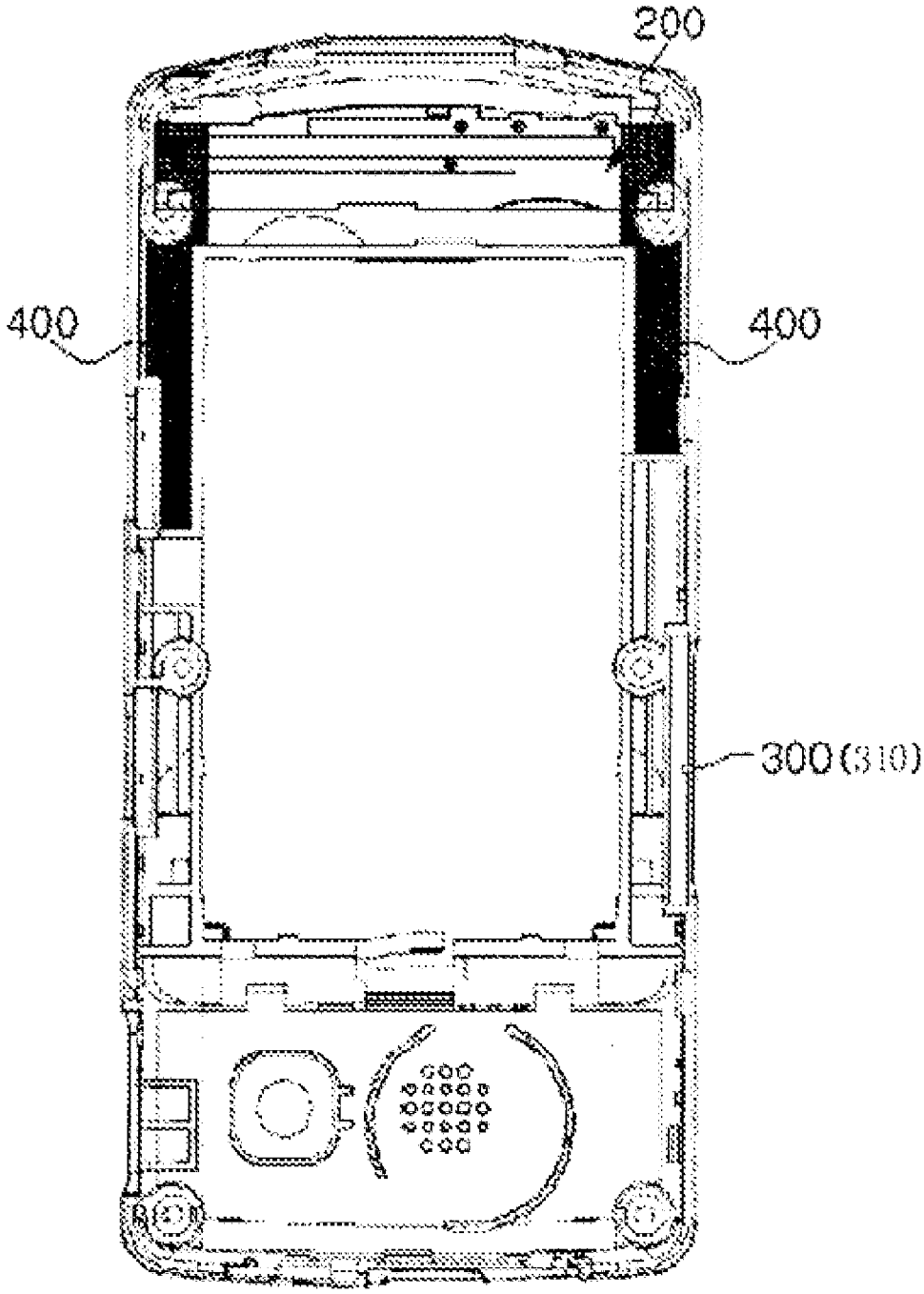
FIG. 4A is a diagram showing a construction in which a conductive conductor pattern is combined with a terminal body cover according to an embodiment of the present invention.

FIG. 4A is a diagram showing a construction in which the conductive conductor pattern 400 is combined with a terminal body cover 300 according to an embodiment of the present invention.

As shown in FIG. 4A, the conductive conductor pattern 400 includes a plurality of conductor elements which are formed on one side surface of the body cover 310 of a terminal and are symmetrically spaced apart from each other at regular intervals.

The conductive conductor pattern 400 is spaced apart from the antenna pattern part 200 by a predetermined distance to correspond to the predetermined location of the antenna pattern part 200. In this case, coupling occurs between the antenna pattern part 200 formed on the PCB 100 and the conductive conductor pattern 400 formed in a predetermined pattern on one side surface of the body cover 310 of a terminal which covers the antenna pattern part 200, so that current components are transferred from the antenna pattern part 200 to the conductive conductor pattern 400 formed on the body cover 310 of a terminal.

As described above, according to the embodiment of the present invention, current components generated in the antenna pattern part 200 are dispersed to the antenna pattern part 200 and the conductive conductor pattern 400 formed on the body cover 310 of a terminal, thereby blocking electromagnetic waves directed at a human body while maintaining similar radiation performance.

Figure 4B:
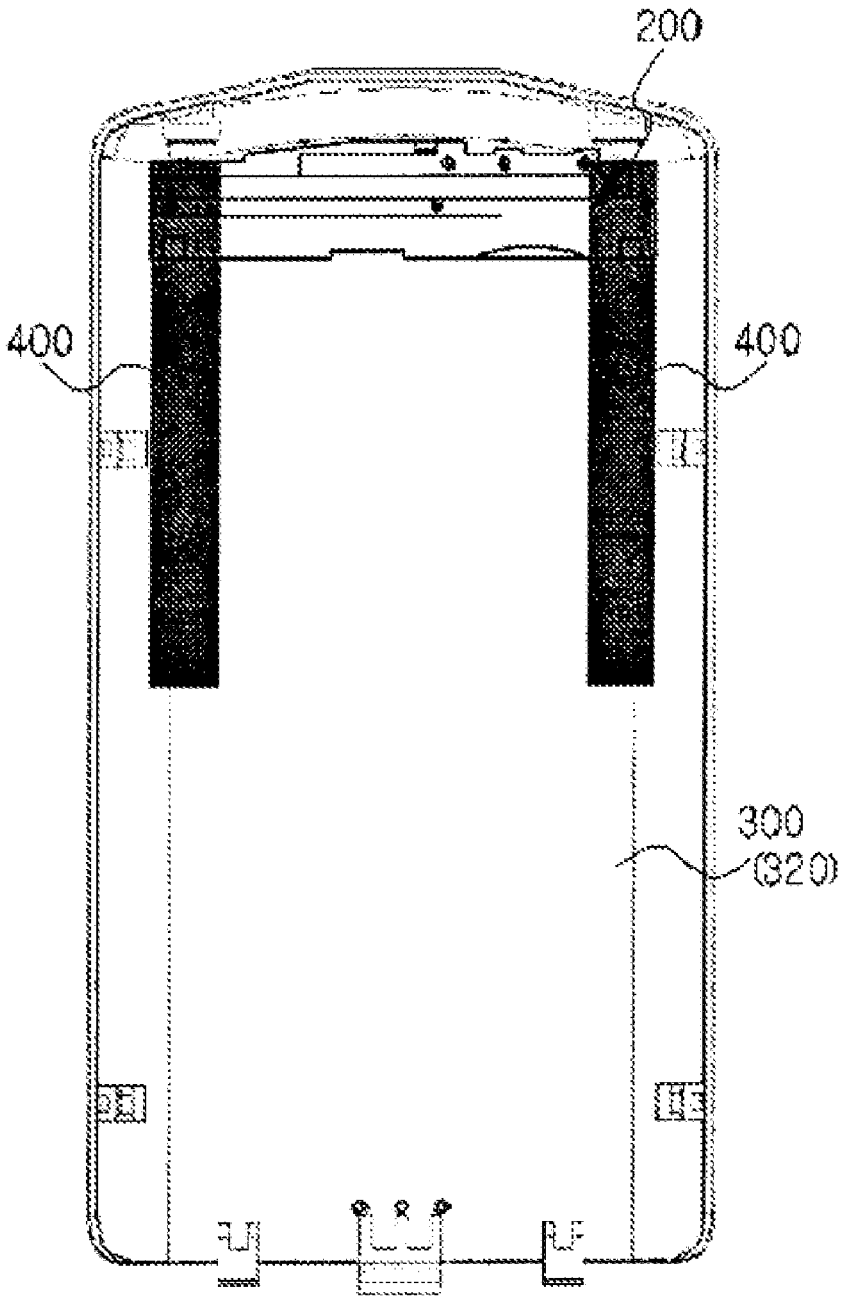
FIG. 4B is a diagram showing a construction in which a conductive conductor pattern is combined with the battery cover of a terminal according to another embodiment of the present invention.

FIG. 4B is a diagram showing a construction in which the conductive conductor pattern 400 is combined with the battery cover 320 of a terminal according to another embodiment of the present invention As shown in FIG. 4B, the conductive conductor pattern 400 includes a plurality of conductor elements which are formed on one side surface of the battery cover 320 and are symmetrically spaced apart from each other at regular intervals.

The conductive conductor pattern 400 is spaced apart from the antenna pattern part 200 by a predetermined distance to correspond to a predetermined location of the antenna pattern part 200.

In this case, coupling occurs between the antenna pattern part 200 formed on the PCB 100 and the conductive conductor pattern 400 formed in a predetermined pattern on one side surface of the battery cover 320 which covers the antenna pattern part 200, so that current components are transferred from the antenna pattern part 200 to the conductive conductor pattern 400 formed on the battery cover 320.

As described above, according to the present embodiment of the present invention, current components generated in the antenna pattern part 200 are dispersed to the antenna pattern part 200 and the conductive conductor pattern 400 formed on the battery cover 320, thereby blocking electromagnetic waves directed at a human body while maintaining similar radiation performance.

Figure 5A:
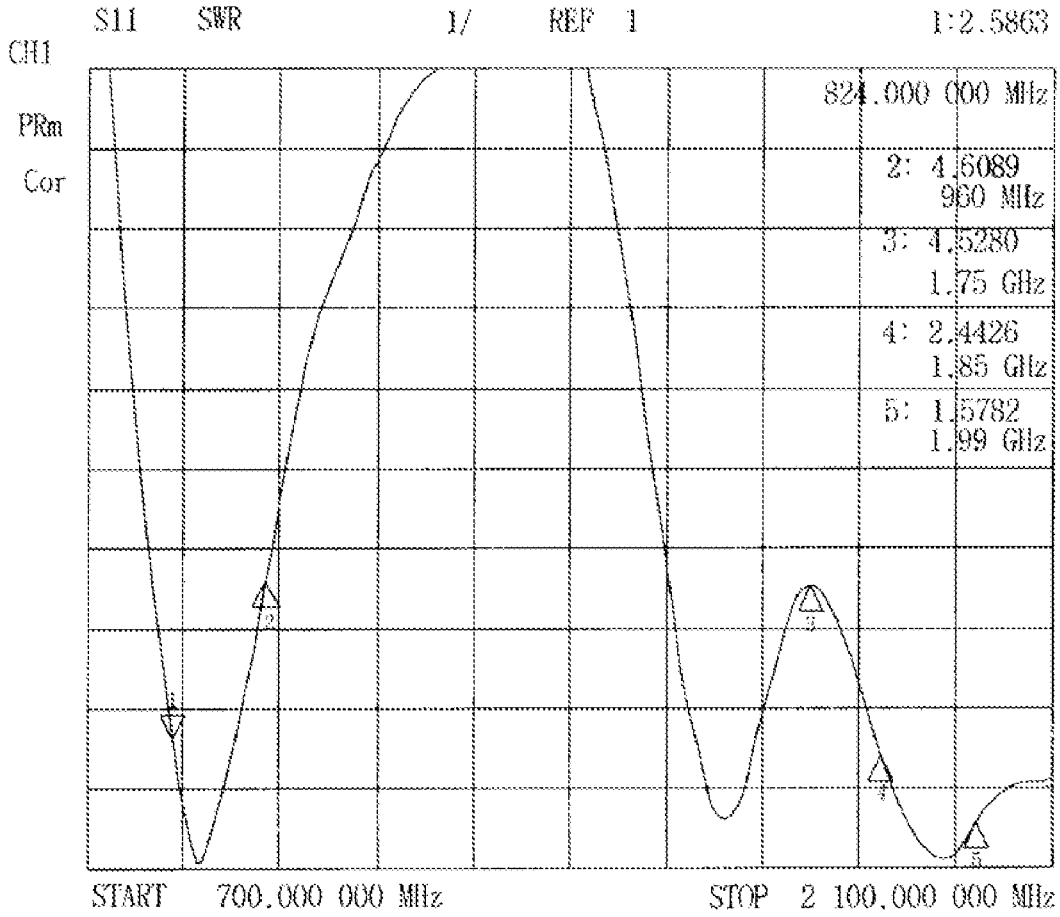
FIG. 5A is a graph illustrating the VSWR of an internal antenna capable of mitigating the effect of electromagnetic waves on a human body using coupling according to an embodiment of the present invention.

FIG. 5A is a graph illustrating the VSWR (Voltage Standing Wave Ratio) of an internal antenna capable of mitigating the effect of electromagnetic waves on a human body using coupling according to an embodiment of the present invention.

As shown in FIG. 5A, in the antenna according to the embodiment of the present invention, resonant frequencies are generated in the GSM 850 (824 MHz~894 MHz) band and the PCS 1900 (1850 MHz~1990 MHz) band for which the standards regarding the influence on a human body have been stipulated.

Figure 5B:
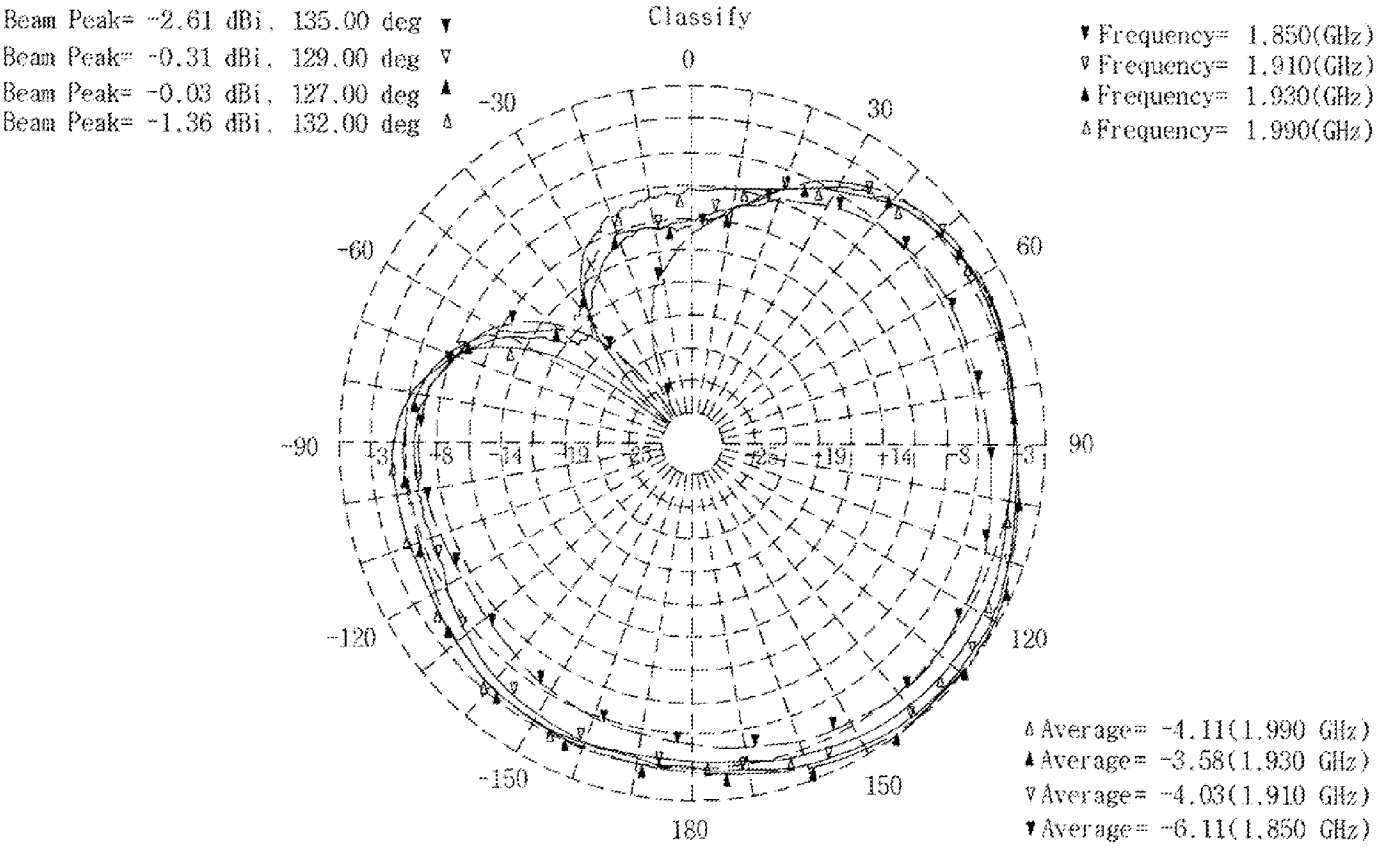
FIG. 5B is a graph illustrating the radiation pattern of an internal antenna capable of mitigating the effect of electromagnetic waves on a human body using coupling according to an embodiment of the present invention.

FIG. 5B is a graph illustrating the radiation pattern of the PCS 1900 (1850 MHz~1990 MHz) band which is the higher of the frequency bands illustrated in FIG. 5A.

As shown in FIG. 5B, the section of a radiation pattern in the direction having the effect of electromagnetic waves on a human body is generated in a low energy density. In this case, the section of the radiation pattern which exerts an effect on a human body is generated within the range of −60 to 0 degrees.

Accordingly, the internal antenna capable of mitigating the effect of electromagnetic waves on a human body using coupling according to the present embodiment of the present invention has the effect of blocking electromagnetic waves directed at a human body.

As described above, the present invention has an effect in which coupling occurs between the antenna pattern part formed on the PCB and the conductive conductor pattern formed in a predetermined pattern on one side surface of the cover which covers the antenna pattern part, so that current components are transferred from the antenna pattern part to the conductive conductor pattern, thereby blocking electromagnetic waves directed at a human body.

As described above, the present invention has an effect in which coupling occurs between the antenna pattern part formed on the PCB and the conductive conductor pattern formed in a predetermined pattern on one side surface of the cover which covers the antenna pattern part, so that current components are transferred from the antenna pattern part to the conductive conductor pattern, thereby blocking electromagnetic waves directed at a human body.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An internal antenna for mitigating an effect of electromagnetic waves on a human body using coupling, comprising:

an antenna pattern part formed on a Printed Circuit Board (PCB) of a mobile communication terminal; and a conductive conductor pattern formed in a predetermined pattern on one side surface of a cover which covers the antenna pattern part, wherein coupling occurs between the antenna pattern part formed on the PCB and the conductive conductor pattern formed on one side surface of the cover, so that current components are transferred from the antenna pattern part to the conductive conductor pattern, and wherein the conductive conductor pattern formed on one side surface of the cover includes a plurality of conductor elements that are symmetrically spaced apart from each other at regular intervals.

2. The internal antenna as set forth in claim 1, wherein the conductive conductor pattern is spaced apart from the antenna pattern part by a predetermined distance to correspond to a predetermined location of the antenna pattern part.

3. The internal antenna as set forth in claim 1, wherein the conductive conductor pattern is any one of a metal sheet pattern, a tin plating pattern, a Flexible Printed Circuit Board (FPCB) pattern and a film pattern.

4. The internal antenna as set forth in claim 1, wherein the cover is any one of a body cover or battery cover of the mobile communication terminal.

5. The internal antenna as set forth in claim 1, wherein the antenna pattern part operates in a dual frequency band.

* * * * *